United States Patent [19]

Woolslayer et al.

[11] 3,986,619

[45] Oct. 19, 1976

[54] PIPE HANDLING APPARATUS FOR OIL WELL DRILLING DERRICK

[75] Inventors: Homer J. Woolslayer; Cecil Jenkins, both of Tulsa, Okla.

[73] Assignee: Lee C. Moore Corporation, Tulsa, Okla.

[22] Filed: June 11, 1975

[21] Appl. No.: 585,775

[52] U.S. Cl. ..... 214/2.5

[51] Int. Cl.[2] ..... E21B 19/14

[58] Field of Search ..... 214/2.5; 175/85

[56] References Cited

UNITED STATES PATENTS 3,633,771 1/1972 Woolslayer et al. ..... 214/2.5

*Primary Examiner*—Stanley H. Tollberg

*Attorney, Agent, or Firm*—Brown, Murray, Flick & Peckham

[57] ABSTRACT

The inner end of a boom is pivotally supported on a horizontal axis in front of a well, over which there is an oil well drilling derrick. Pivotally connected to the outer end of the boom on an axis parallel to the axis just mentioned, is clamping means for gripping drill pipe connected at one end to elevators in the derrick. The clamping means allows the free end of the drill pipe to swing across the boom as the outer end of the boom is raised or lowered. Line means connected at one end with the traveling block that raises and lowers the elevators and at the other end to the boom pass around sheaves mounted in the derrick. Also connected with the boom is a counterweight for swinging it in one direction in a vertical plane when the traveling block moves in the same direction as the boom. The sheaves are so positioned that when the traveling block moves in the opposite direction the line means will pull the boom in that direction. Means are provided for keeping tension on the line means at all times.

11 Claims, 12 Drawing Figures

VIII
VIII 85
86
87
72
84
71
89
91
98
74
96
88
84
97
95
83
92
82
76
79
73
78
81
94
93
77

PIPE HANDLING APPARATUS FOR OIL WELL DRILLING DERRICK

In our copending patent application, Ser. No. 479,296, filed June 14, 1974, now U.S. Pat. No. 3,887,086 drill pipe is raised from a rack and moved endwise into an oil well drilling derrick where its inner end is then gripped by the usual elevators and raised by the traveling block up into the derrick. As this occurs, the outer or lower end of the pipe swings in toward the derrick until the pipe is in vertical position over the well. To guide the pipe as it swings into the derrick, there is a steady arm, one end of which engages the lower side of the pipe while it is horizontal and the other end of which is pivoted on a horizontal axis near the derrick. As the inner end of the pipe is raised by the elevators, the steady arm is swung upwardly and toward the derrick to guide the opposite end of the pipe until it is in position over the well.

In U.S. Pat. No. 3,613,905 a boom is shown for swinging drill pipe up from a horizontal rack to a vertical position in an oil well derrick with the aid of a line hung in the derrick. A strongback pivoted to the outer end of the boom is first clamped onto the pipe from above the pipe on the rack.

Both the steady arm in our application and the boom in the patent are operated by fluid pressure cylinders, but it is an object of this invention to provide pipe handling apparatus in which a boom for lifting pipe and guiding it into a derrick or for removing it therefrom and racking it is swung in one direction by the drawworks and in the opposite direction by a counterweight while pipe carried by the boom is connected with the elevators in the derrick. Another object is to provide for limited vertical movement of the pipe while the boom is raised, without allowing the boom to move.

The invention is illustrated in the accompanying drawings, in which.

Figure 1:
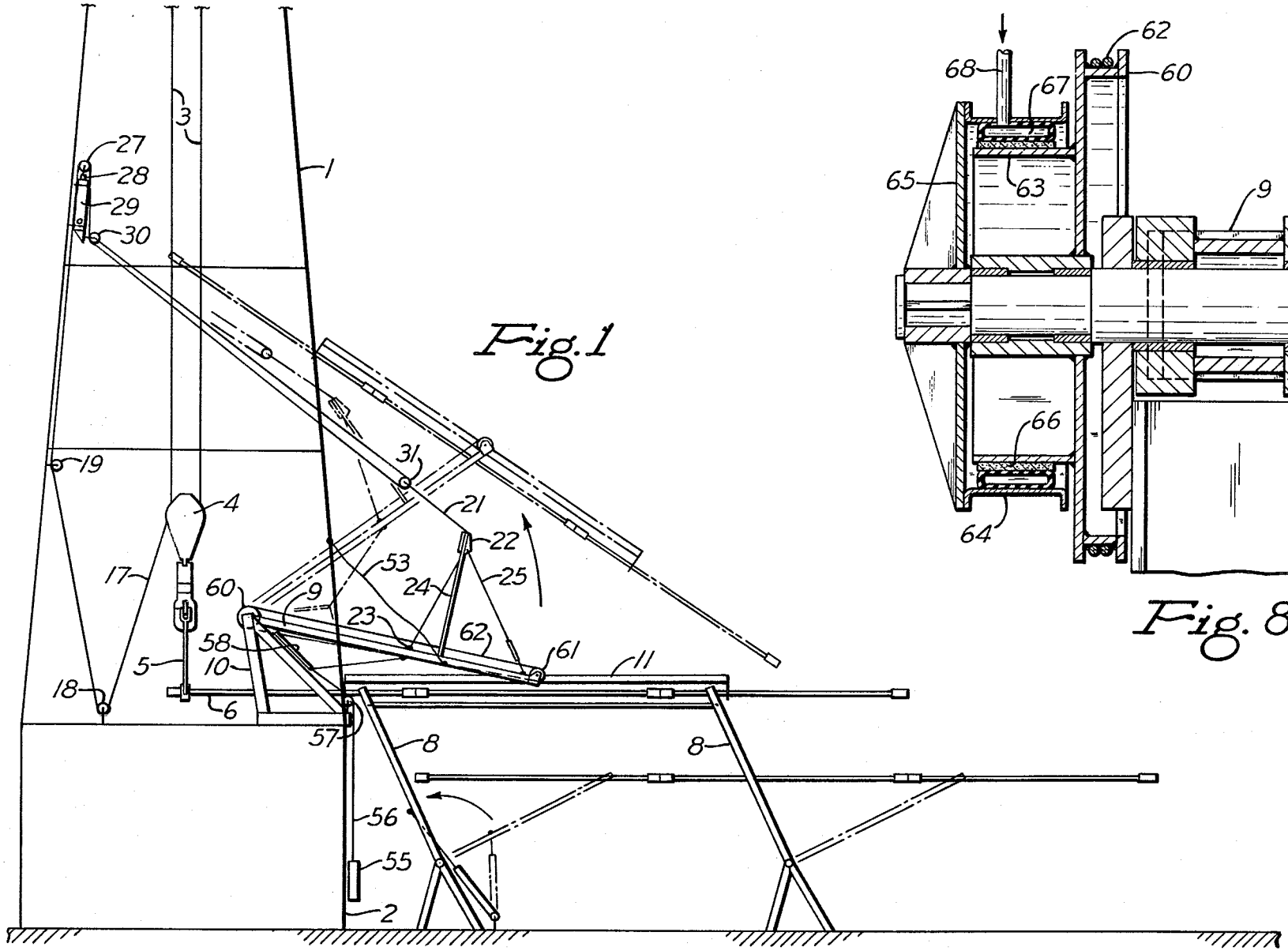
FIG. 1 is a side view showing pipe about to be elevated in an oil well drilling derrick.

Referring to FIG. 1 of the drawings, an oil well derrick 1 is shown in outline mounted on a substructure 2. Suspended from the crown block (not shown) of the derrick by lines 3 connected with the drawworks (not shown) is the usual traveling block 4 that supports conventional elevators 5 for gripping the upper end of a pipe or a stand of pipe going into or coming out of the well. Usually, three pipes are connected together end to end to form a stand. In front of the derrick substructure there is a pipe rack (not shown) in which pipe are stored in horizontal or reclining position. The pipe rack is one in which each successive pipestand 6 can be lifted from the rack and simultaneously moved endwise until its inner end is over the well as shown. A rack suitable for this purpose is shown in our copending patent application referred to above and also in copending application, Ser. No. 593,473, filed July 7, 1975.

Figure 8:
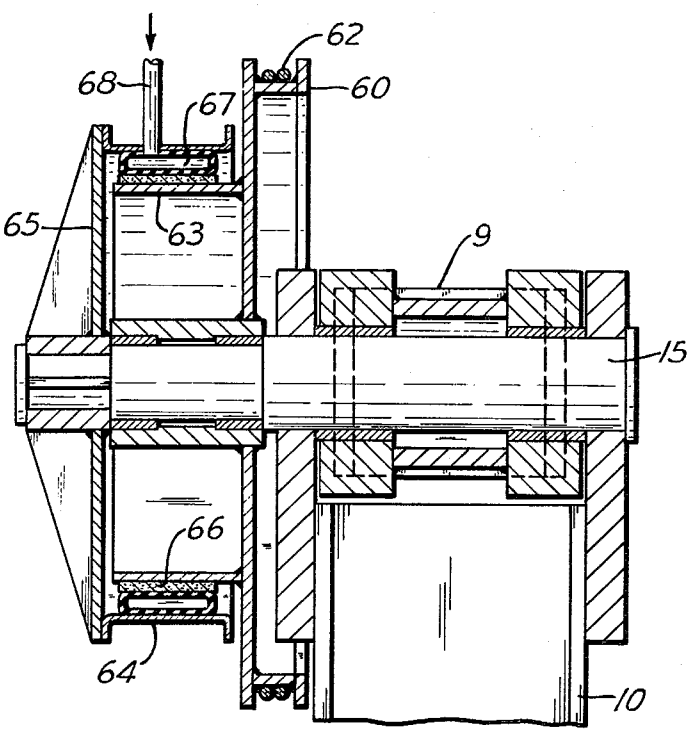
FIG. 8 is an enlarged vertical section taken on the line VIII—VIII of FIG. 2.
Figures 2, 6, 7:
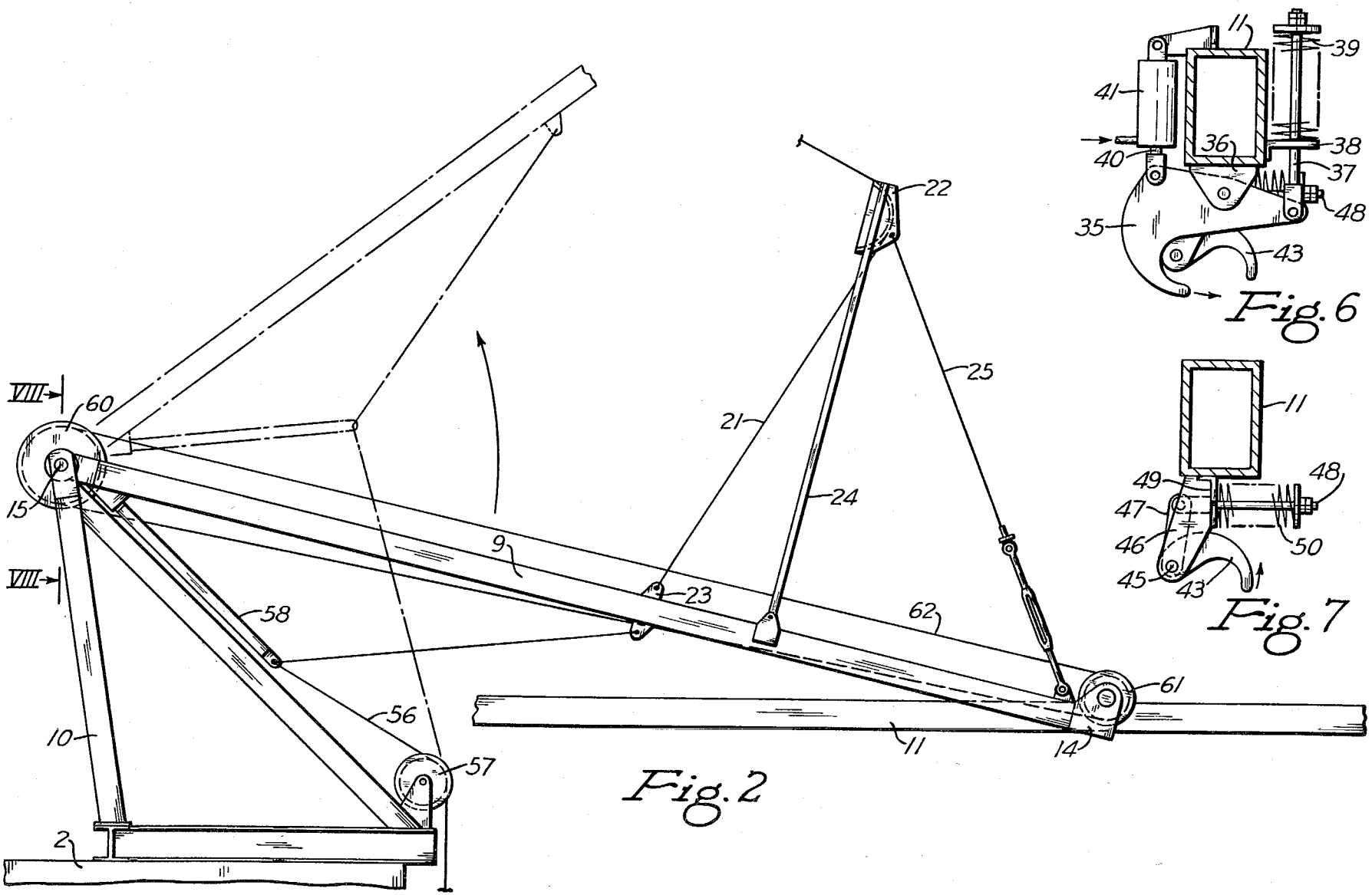
FIG. 2 is an enlarged fragmentary side view of the pipe handling apparatus in its lower position.
FIGS. 6 and 7 are cross sections taken on the lines VI—VI and VII—VII, respectively, of FIG. 4.
Figure 3:
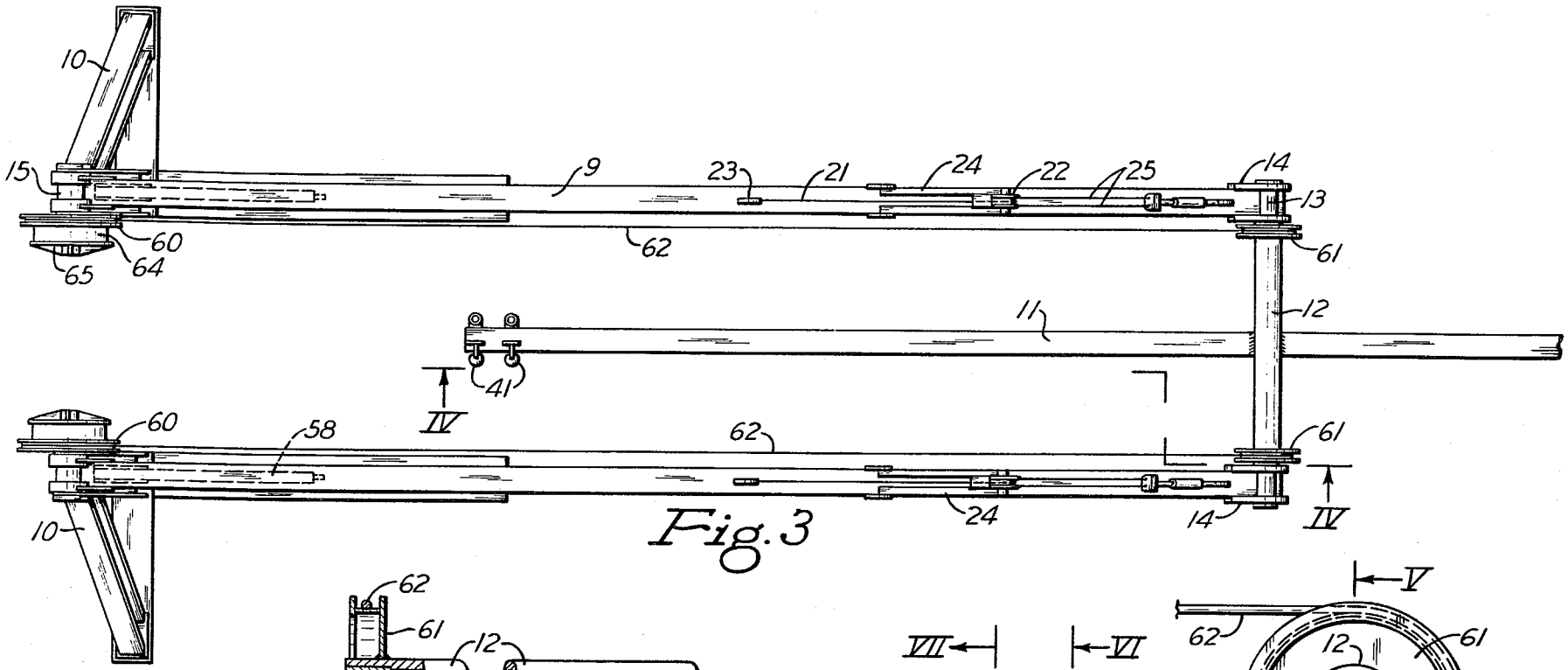
FIG. 3 is a plan view of the apparatus shown in FIG. 2.
Figure 5:
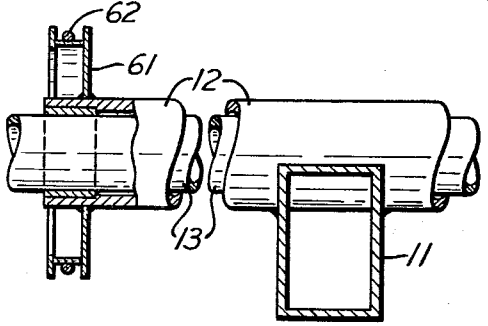
FIG. 5 is a fragmentary vertical section taken on the line V—V of FIG. 4.

The pivoted transfer arms 8, which lift a pipestand from the rack and carry it to the derrick, form a support for the horizontal stand while it is being gripped from above by clamping means supported by the outer end of a reclining boom 9, the inner end of which is pivotally mounted on a horizontal axis on suitable pedestals 10 on the derrick floor in front of the well as shown in FIGS. 1, 2 and 3. Each side of the boom is formed from a long beam. The clamping means for the pipestand preferably include a strongback, which is a long and rigid beam 11, the opposite ends of which support clamps for gripping the pipestand at widely spaced points. The clamps will be described later. The central portion of the strongback is secured to a long transverse sleeve 12 midway between its ends. As shown in FIGS. 3 and 5, extending through the sleeve is a pipe 13, the opposite ends of which are rigidly mounted in brackets 14 secured to the opposite sides of the boom. The sleeve can turn on this pipe, which serves as an axle. The inner ends of the beams that form the sides of the boom are pivotally mounted on horizontal shafts 15 rigidly mounted in the upper ends of pedestals 10 as shown in FIG. 8, so that the boom can swing up and down to raise and lower the strongback in a vertical plane containing the axis of the well.

Figure 9:
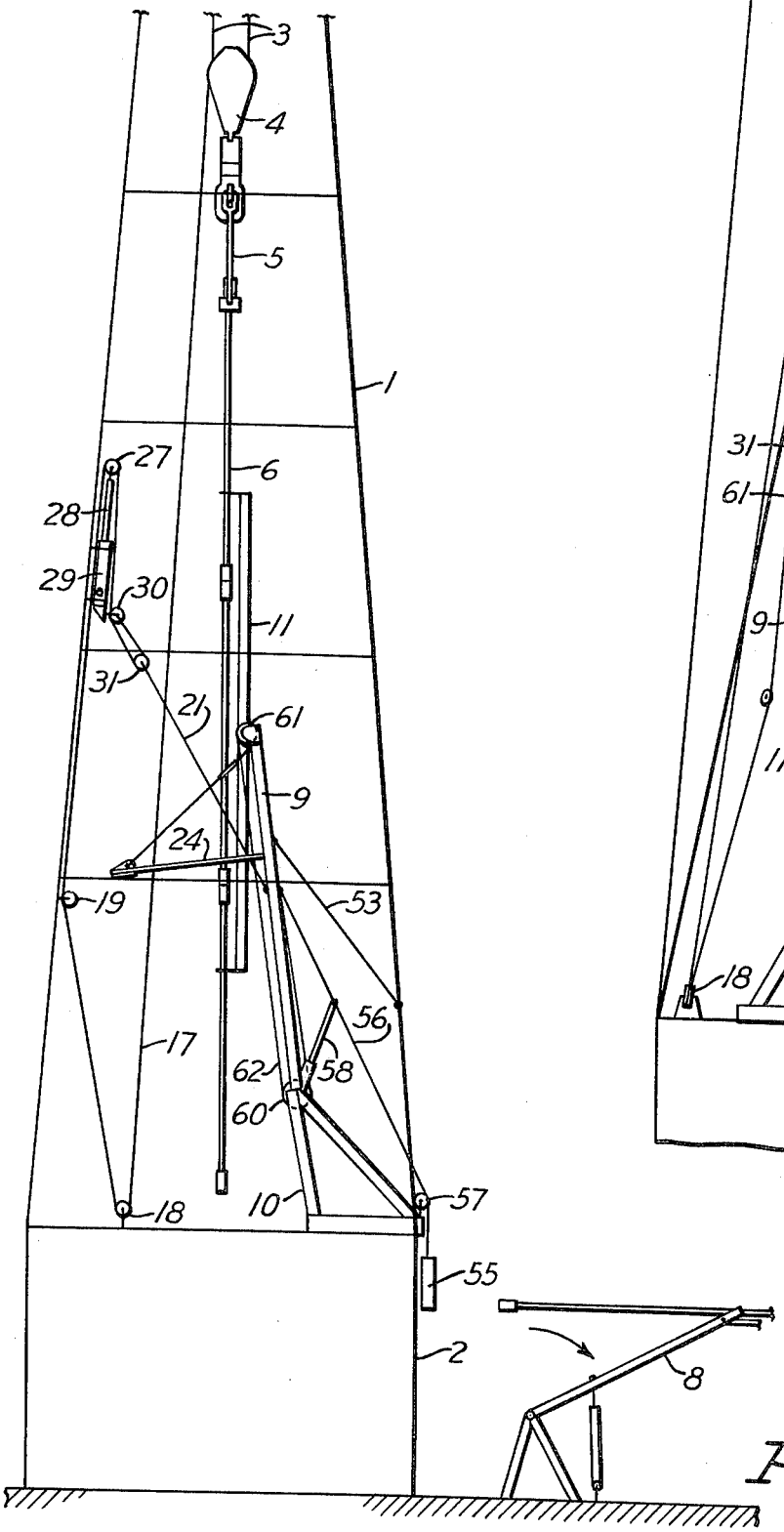
FIG. 9 is a side view, similar to FIG. 1, but showing pipe suspended in upright position in the derrick.
Figure 10:
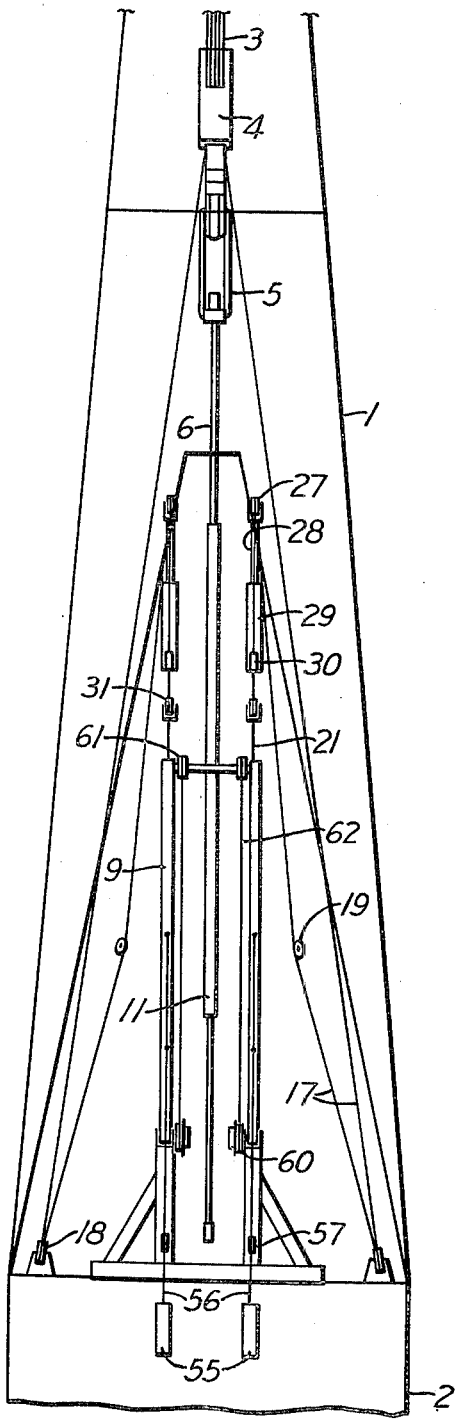
FIG. 10 is a front view of the derrick of FIG. 9.

It is a feature of this invention that the boom shown in FIG. 1 is raised by means of the traveling block. To accomplish this, line means connect the traveling block with the boom, the line means extending around sheaves mounted in such positions in the derrick that as the traveling block rises in the derrick the boom is swung upwardly. The line means preferably include either a single wire line 17 connected midway between its ends to the traveling block, or a pair of lines connected at one end to the traveling block. From there, as shown in FIGS. 1, 9 and 10, the line or lines extend down around laterally spaced snatch blocks 18 that may be connected to the derrick floor, and then up behind sheaves 19 mounted in the derrick at its back and on up and around other sheaves and then forward to a connection with the boom. To obtain good leverage on the boom for raising it, the opposite ends or wire line 17 preferably are connected to raising lines 21 that extend forward and down around the front of shoes 22 and then down to anchor points 23 on the two side beams of the boom as shown in FIGS. 1 and 2. The shoes are mounted on the upper ends of a pair of struts 24, the lower ends of which are connected to the sides of the boom. The struts are prevented from being pulled over backwards by means of guy wires 25 connecting the shoes with the outer end of the boom.

For a purpose that will be explained presently, the uppermost sheaves 27 supporting wire line 17 preferably are carried by the upper ends of piston rods 28 that extend down into a pair of upright fluid pressure cylinders 29 (FIGS. 1, 9 and 10) rigidly mounted in the back of the derrick. The lower end of each cylinder supports still another sheave 30. The line extends from the uppermost sheaves 27 down around sheaves 30 and forward to raising lines 21. At this point, wire line 17 preferably extends around sheaves 31 connected to the upper ends of the raising lines 21 and back to the fluid pressure cylinders where the wire line is anchored.

Figure 4:
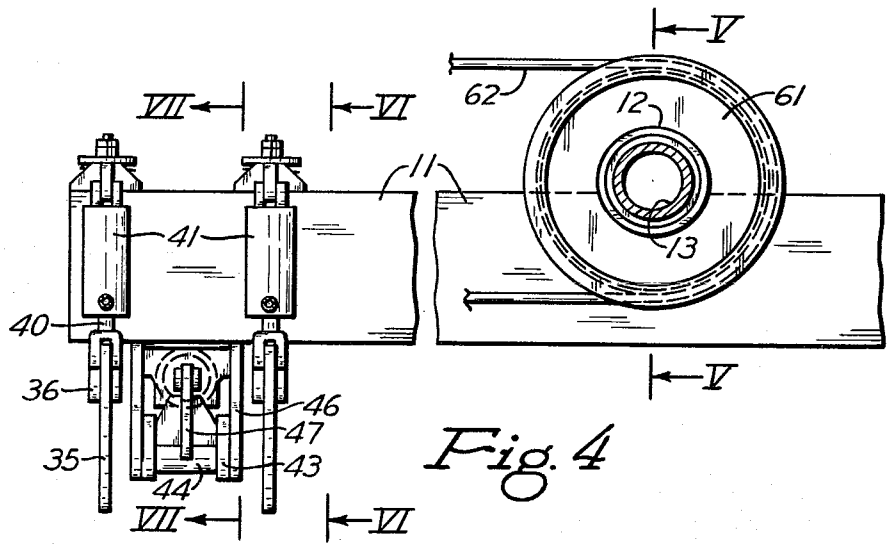
FIG. 4 is an enlarged fragmentary side view taken on the line IV—IV of FIG. 3.

Assuming that transfer arms 8 have lifted a pipestand from a pipe rack in front of substructure 2 and moved its leading or inner end into position over the well as shown in FIG. 1, the pipestand will be located directly below lowered strongback 11 in a position to be connected to it and to the elevators 5. The pipestand is connected to the strongback by means of two sets of clamps suspended from the strongback. Each set includes a pair of spaced plate hooks 35 extending across the bottom of the strongback and pivotally supported by brackets 36 as shown in FIGS. 4 and 6. One end of each plate hook is pivotally attached to the lower end of a rod 37 extending slidably up through a bracket 38 mounted on the side of the strongback. A coil spring 39, mounted on the rod, urges the rod upwardly to swing the hook inwardly beneath bracket 36. The other end of the plate hook is pivotally connected to the lower end of a piston rod 40 extending up into an air cylinder 41 supported at the side of the strongback. To swing the hook outwardly into the position shown in FIG. 6, air pressure is supplied to the lower end of the cylinder to raise the piston therein. Of course, this will compress the coil spring.

When air pressure is released from cylinders 41, springs 39 will rotate the hook plates to cause them to swing under a pipestand that has been raised beneath the strongback. The hook plates will engage and hold the pipestand against a pair of hooks 43 above it between each pair of hook plates. As shown in FIGS. 4 and 7, each pair of hooks 43 are rigidly mounted on a sleeve 44 between them, which in turn is rotatably mounted on a shaft 45 secured at its ends in supporting brackets 46 extending downwardly from the strongback. Also rigidly connected to the sleeve is the lower end of an arm 47, the upper end of which is pivotally connected to one end of a horizontal rod 48. This rod slides in a bracket 49 on the bottom of the strongback, and is encircled by a coil spring 50 that normally holds hooks 43 in their lower position. When the strongback is lowered onto the pipestand, the springs cushion the impact by permitting hooks 43 to pivot on shafts 45.

As soon as the strongback has latched onto a pipestand, the drawworks is operated to raise the traveling block, which thereby carries the inner end of the pipestand up into the derrick. At the same time, as indicated in dotted lines in FIG. 1, the traveling block pulls wire line 17 upwardly in the derrick and that line pulls raising lines 21 upwardly and rearwardly to swing the boom up into the derrick. As the boom is moving upwardly in this manner, the ascending inner or upper end of the pipestand causes the strongback to pivot relative to the boom, so that what originally was the outer end of the horizontal strongback swings rearwardly between the opposite sides of the boom until the entire pipestand is behind the boom. Rearward movement of the boom is stopped by a snub line 53 connecting it to the front of the derrick. It is stopped in such a position that the pipestand carried by it is suspended vertically from the elevators, directly over the well as shown in FIGS. 9 and 10.

In order to start the boom to swing down when it is supposed to, counterweights 55 are suspended from it by means of lines 56 attached to the opposite sides of the boom about midway between its ends. These lines pass over sheaves 57 mounted on the lower front ends of pedestals 10. To maintain the lines in contact with these sheaves as the boom is lowered, as shown in FIG. 1 portions of the lines between the boom and the sheaves are connected to struts 58 that project from the inner end of the boom a distance that is less than the distance between the inner end of the boom and the sheaves.

Since from its suspended position in the derrick the vertical pipestand should be lowered straight down in order to connect it to the upper end of a pipe supported by the rotary table, it is highly desirable that means be provided that will prevent the boom from starting to swing forward and down before the traveling block has lowered the pipestand the necessary distance, which would happen if wire line 17 allowed sheaves 31 to start to move away from cylinders 29 the moment the traveling block starts down. Accordingly, means independent of the boom are provided for maintaining tension on the wire line to hold the boom stationary as the traveling block lowers the vertical pipestand, which can slide down through the clamps on the strongback. The air cylinders 29 are provided for that purpose and their operation will now be described.

At the time that a pipestand supported by transfer arms 8 is gripped by the strongback, there is no air pressure in cylinders 29, so sheaves 27 are in their lower position as shown in FIG. 1. As the boom is swung upwardly, the air is replaced in the cylinders to raise the pistons in them to points near, but spaced from, the upper ends of the cylinders. When the boom reaches its uppermost position shown in FIG. 9, in which the lower end of the vertical pipestand is a short distance above the upper end of the pipe in the well, the traveling block can continue to move upwardly a short distance if necessary because the tension on wire line 17 will force the pistons downwardly in the air cylinders to permit the upper end of the line to move further up with the traveling block. The pipestand will be pulled upwardly in the clamps on the strongback as the air in the cylinders is compressed further by the pistons forced down in them. Then, when the traveling block moves downwardly to lower the pipestand toward the rotary table to make up the joint with the pipe suspended from the slips, the air pressure in the cylinders will simultaneously move the pistons upwardly to keep the tension on line 17 and thereby prevent sheaves 31 from moving down and allowing the boom to swing forward. As soon as the pipe joint is made up, the strongback is released from the pipestand so that the boom can return to its lower position.

After the lower end of the pipestand has been connected to the pipe in the well and the slips have been removed, the traveling block will be lowered farther in the derrick to lower the pipestand into the well. If the pistons are depressed partway in cylinders 29 at this time, the piston rod sheaves 27 would be forced upwardly as the traveling block started down and they would maintain tension on the wire line, so the boom would remain in its upper position for a short time instead of starting to swing down. To prevent this, the air pressure in the cylinders is released so that the boom can start down the moment the traveling block begins to descend after the strongback has been released from the pipestand.

Thus far, the apparatus disclosed herein has been described while the boom is swinging a pipestand up from a pipe rack. At such a time, the position of the strongback and pipestand relative to the boom is controlled by the pipestand itself, because its inner or upper end is controlled by the position of the elevators attached to it. There is no such control over the position of the strongback while it is being lowered to pick up a pipestand from the transfer arms, or while the boom is being raised after depositing a pipestand on those arms. Therefore, additional control means must be provided so that the empty strongback will be horizontal in its lower position for picking up a pipestand and vertical in its upper position for latching onto a pipestand. This control is accomplished by drums and wire lines associated with the boom, as will be described now.

An inner drum 60 is rotatably mounted on the projecting inner end of each pedestal shaft 15, and a pair of outer drums 61 are rigidly mounted on sleeve 12 at the outer end of the boom. A wire line 62 is wrapped tightly around each of the inner drums 60 and may be secured to it in any suitable manner. The line also is wrapped around the outer drum at the same side of the boom. As long as the inner drums are free to rotate on shafts 15, they do not exert any control over the position of the strongback, so a pipestand carried by it is free to turn the strongback on its transverse axis. However, if the inner drums are held stationary, raising or lowering of the boom will cause lines 62 to rotate the outer drums 61, which in turn will rotate sleeve 12 and the strongback. The diameter of the outer drums bears such a relation to the diameter of the inner drums that when the boom is raised and lowered, the strongback will be maintained in the correct position relative to the boom and the adjacent horizontal or vertical pipestand.

In order to keep the inner drums 60 from rotating when desired, each of them carries on one side a brake drum 63 that normally turns inside of an encircling brake drum 64 mounted on a flange 65 that is rigidly mounted on the inner end of shaft 15. Encircling the inner brake drum, to which it is attached, is a brake lining 66 that normally slides freely against the inner surface of an encircling flexible tube 67 that has an air inlet connected to a pipe 68, by which the tube can be inflated sufficiently to stop the inner brake drum from rotating. This brake is applied every time that the boom is to be swung up or down without carrying a pipestand, but is released as soon as the strongback grips a pipestand.

In case the pipe is coming out of the hole instead of going into it as has been described, the traveling block is raised in the derrick to pull the string of pipe up. As the traveling block rises, it carries wire line 17 with it and, therefore, swings the boom upwardly. During this operation, air under pressure is being delivered to the lower end of cylinders 29. The pipe is pulled far enough to permit the slips to be applied directly below the exposed pipestand. This further movement of the traveling block will generally cause wire line 17 to depress the pistons in the cylinders. The strongback then is clamped to the pipestand suspended from the elevators, following which the traveling block is lowered a short distance in order to lower the pipe onto the slips so that the upper pipestand can be disconnected from the pipe below. As the traveling block is lowered for this purpose, the air pressure in the cylinders will force their pistons upwardly to maintain the tension on the line.

After the joint has been broken out, the traveling block is raised again to completely separate the pipestand from the pipe below, and this will compress the air cylinders again to some extent. The air in the cylinders is then released at the same time that the traveling block is lowered, whereby the boom will immediately start to swing forward and carry the pipestand with it down to horizontal position on the transfer arms. Then, the strongback clamps are released from the pipestand and the boom is raised to receive the next pipestand pulled out of the hole by the traveling block. Of course, before the traveling block starts to raise the boom, the brake tubes 67 are inflated to apply the brakes so that wire lines 62 will rotate the strongback to position it vertically by the time it reaches its uppermost position, so that it can grip the next pipestand that has been pulled from the hole.

Figures 11, 12:
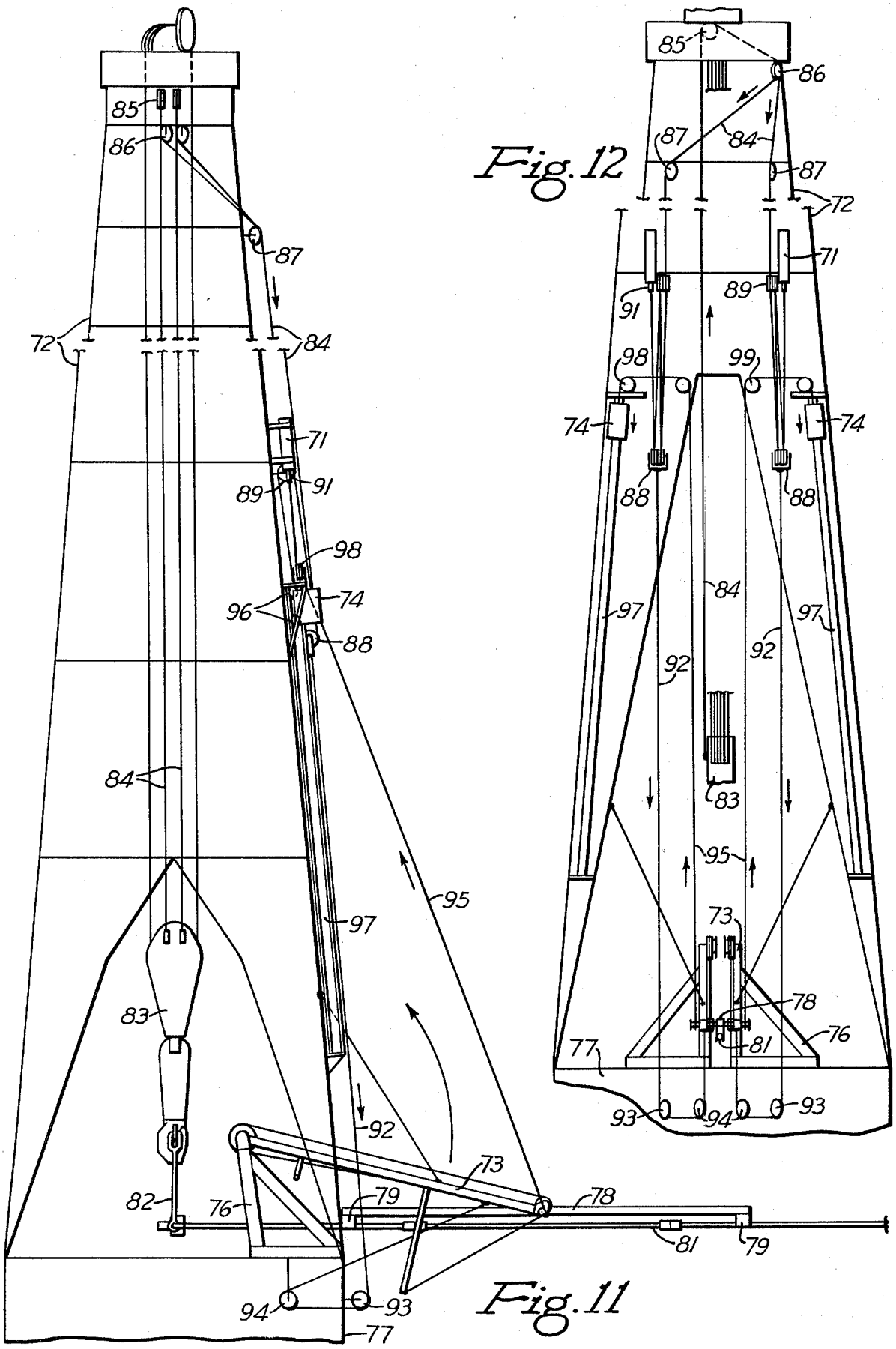
FIGS. 11 and 12 are side and front views, respectively, of a modification.

In the modification disclosed in FIGS. 11 and 12, the fluid pressure cylinders 71 have been inverted and moved to the front of the derrick 72. With this system, the lines and sheaves that are inside the derrick in the first embodiment are located outside of it, which is preferred. Also, instead of the boom 73 being raised by the traveling block, it is raised by counterweights 74 and is lowered by the traveling block. Like the boom first described, the inner end of the boom in FIG. 11 is pivotally mounted in pedestals 76 mounted on the derrick substructure 77 in front of the well. The outer end of the boom carries a strongback 78, which may be provided with clamps 79 like those described before. When the boom is down, the clamps grip a horizontal pipestand 81 that has been lifted from a pipe rack in the same way as the one first described. The inner end of the pipestand is connected to elevators 82 suspended from a traveling block 83 in the derrick.

Connected to one side of the traveling block are the ends of a pair of wire lines 84 that extend up and over sheaves 85 supported near the top of the derrick. From these sheaves the two lines extend down and under another pair of sheaves 86 and then forward and over a pair of sheaves 87 supported in front of the derrick. From these last sheaves the lines extend down and around vertically movable pulley blocks 88 and then up and over stationary pulley blocks 89 supported by the derrick. The lines may extend around these blocks two or more times and then finally extend from the lower blocks up to the lower ends of piston rods 91 projecting downwardly from the cylinders. The lower blocks 88 support the upper ends of a pair of lines 92 that extend downwardly and around sheaves 93 supported in front of the substructure. From these sheaves the lines extend back into the substructure and up around a further pair of sheaves 94 and then forward to anchor points near the outer end of the boom. When the traveling block is in its lower position as shown, wire lines 84 hold the lower blocks in their upper position and they, through lines 92 attached to them, hold the boom in its lower position against the tendency of counterweights 74 to raise the boom, since the weights are connected by lines 95 to the outer end of the boom.

The two counterweights are provided with wheels 96 that run on tracks 97 extending down the front of the derrick near its front corners. Each counterweight is connected to the upper end of a line 95 that extends upwardly over and then down around a pair of sheaves 98 and 99 supported in front of the derrick. From sheaves 99 the two lines extend down to the outer end of the boom. While the boom is in its lower position, the counterweights are held at the upper ends of the tracks as shown.

After the strongback has been clamped onto a horizontal pipestand with piston rods 91 held in their upper position by compressed air in cylinders 71, the drawworks is operated to raise the traveling block and the inner end of the pipestand, which is connected to the elevators. As the traveling block moves upwardly in the derrick, wire lines 84 allow lower pulley blocks 88 to descend, which permits the counterweights to move down their tracks and thereby swing the boom upwardly. These movements continue until the strongback reaches a vertical position, with the pipestand suspended from the elevators in line with a string of pipe suspended in the well by the usual slips. Air is then released from the lower ends of the cylinders to allow the piston rods to descend as the traveling block lowers the pipestand to permit make-up of the joint at the slips. The downwardly moving piston rods allow lines 84 to pull through the pulley blocks without raising the counterweights, which would permit the boom to start to swing down before it should.

After make-up, the clamps are released from the pipestand, air pressure is delivered to the lower ends of cylinders 71 to raise the pistons therein to cause the boom to swing away from the pipe, and the traveling block lowers the pipe into the well. As the block moves downwardly, it pulls lines 84 with it and they, through lines 92, pull the boom down against the resistance of the counterweights, which will be pulled up their tracks by lines 95.

In coming out of the hole, the pipe is raised into the derrick by the traveling block while the piston rods 91 are held in their upper or retracted positions. The upward movement of the traveling block in the derrick allows the counterweights to raise the boom as previously explained. With the pipestand up in the derrick, the clamps on the vertical strongback are applied to it and then air is released from the lower ends of cylinders 71 as the traveling block lowers the pipe to set the slips. The pipestand is then disconnected or broken out from the joint at the slips, following which the pipestand is raised again as air pressure is delivered to the cylinders to raise their piston rods to keep tension on the lines. The next step is to lower the traveling block, which will pull the boom down with the pipestand that is supported by it. As the boom swings down, the lower end of the pipestand is swung forward so that by the time the boom reaches its lower position the pipestand is horizontal and ready to be transferred to a pipe rack after the strongback clamps have been released.

The boom is provided with inner and outer wire line drums and brakes the same as the boom first described, so that the position of the strongback will be controlled as the boom swings up or down without a pipestand in its clamps.

In addition to carrying the pipestand and correctly positioning it in its upper and lower positions, the strongback also serves to hold the pipestand steady while the pipe is being made up or broken out when the derrick is mounted on a ship that pitches and rolls. The use of the derrick on a ship is also another reason why the lines must be kept snug by the air pressure cylinders.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. The combination with an oil well drilling derrick provided with elevators for drill pipe and with a traveling block for raising and lowering the elevators in the derrick above a well, of pipe handling apparatus for moving drill pipe detachably connected at one end to said elevators back and forth between suspended upright position in the derrick and a reclining position near its bottom in which the pipe extends forward from the lowered elevators and out of the derrick, said apparatus comprising a boom having inner and outer ends, means for pivotally supporting the inner end of the boom on a horizontal axis in front of the well to enable the boom to be swung in a vertical plane toward and away from said upright position, clamping means for gripping drill pipe that is connected to said elevators, pivotal means pivotally connected to the outer end of the boom on an axis parallel to said horizontal axis and supporting said clamping means, said pivotal means being positioned to allow the free end of drill pipe gripped by said clamping means to swing across the boom as said traveling block and the outer end of the boom are raised or lowered together, line means connected at one end to the traveling block and at the other end to said boom, sheaves mounted in the derrick independently of traveling block sheaves with said line means passing around them, and additional means connected with the boom for swinging it in one direction in said vertical plane when said traveling block moves vertically in the same direction, said sheaves being so positioned that when the traveling block moves in the opposite direction said line means will pull the boom in that direction, whereby the boom is swung up and down as the traveling block moves up and down in the derrick.

2. The combination recited in claim 1, in which said additional means include a counterweight.

3. The combination recited in claim 1, including a first drum rotatably mounted on said horizontal axis, a second drum secured to said pivotal means and rotatable on said parallel axis, means for holding the first drum stationary, and a cable extending around said drums for turning the second drum as the boom is raised or lowered while the first drum is stationary, whereby to control the position of said clamping means relative to the moving boom while no drill pipe is gripped by the clamping means, said drum-holding means being released while the boom is swinging a drill pipe up or down.

4. The combination recited in claim 1, in which said pivotal means is a strongback pivotally connected at its central portion to said boom, and said clamping means are spaced lengthwise of the strongback and project downwardly therefrom while the strongback is in its lower position, and said combination including means below the lowered strongback for raising substantially horizontal drill pipe up to said clamping means to be gripped thereby and by said elevators.

5. The combination recited in claim 1, in which said clamping means include pivotally mounted hooks, springs urging the hooks toward pipe-gripping position, and fluid pressure cylinders operatively connected with the hooks for retracting them against the resistance of the springs.

6. The combination recited in claim 1, including means for limiting upward movement of said boom, and means for maintaining tension on said line means, said tension means being yieldable to permit the traveling block to continue to rise a predetermined distance after the boom has reached its uppermost position.

7. The combination recited in claim 6, in which said additional means swing the boom downwardly, and said tension means include an air pressure cylinder mounted on the derrick, a piston rod projecting from one end of the cylinder, and a piston in the cylinder at the inner end of said rod, the end of the cylinder opposite said one end having an inlet for air under pressure for urging the piston toward said one end, and one of said sheaves is mounted on the outer end of the piston rod, whereby if the traveling block continues to rise after the boom has reached its uppermost position said line means will force the piston rod inwardly of the cylinder.

8. The combination recited in claim 7, in which the air pressure in said cylinder is released when it is desired that the boom should start to swing down as soon as the traveling block starts to descend.

9. The combination recited in claim 6, in which said additional means swing the boom upwardly, and said tension means include an air pressure cylinder mounted on the derrick, a piston rod projecting from one end of the cylinder, a piston in the cylinder at the inner end of the rod, said one end of the cylinder having an inlet for air under pressure for urging the piston toward the opposite end of the cylinder, and said line means include a first line connected at one end to the traveling block and at the other end to the outer end of said piston rod, a pulley riding on said line, a second line connected at one end to said pulley and at the other end to said boom, and a sheave mounted in fixed position below said boom, said second line extending around the bottom of the sheave, whereby when the traveling block starts to descend from its upper position and the air pressure in said cylinder is released said first line will pull the piston rod outwardly of the cylinder to prevent the first and second lines from pulling the boom downwardly.

10. The combination recited in claim 8, in which said additional means include a counterweight, a sheave supported by the derrick, and a line supported by the sheave and connected at its ends to the counterweight and boom.

11. The combination recited in claim 10, in which said cylinder and counterweight are located in front of the derrick.

* * * * *